US006723378B2

(12) United States Patent
Hrubesh et al.

(10) Patent No.: US 6,723,378 B2
(45) Date of Patent: Apr. 20, 2004

(54) FIBERS AND FABRICS WITH INSULATING, WATER-PROOFING, AND FLAME-RESISTANT PROPERTIES

(75) Inventors: Lawrence W. Hrubesh, Pleasanton, CA (US); John F. Poco, Livermore, CA (US); Paul R. Coronado, Livermore, CA (US)

(73) Assignee: The Regents of the University of California, Oakland, CA (US)

( * ) Notice: Subject to any disclaimer, the term of this patent is extended or adjusted under 35 U.S.C. 154(b) by 105 days.

(21) Appl. No.: 10/002,513

(22) Filed: Oct. 25, 2001

(65) Prior Publication Data

US 2003/0082379 A1 May 1, 2003

(51) Int. Cl.[7] ..... B05D 1/00
(52) U.S. Cl. ..... 427/180; 427/393.4
(58) Field of Search ..... 427/180, 393.4

(56) References Cited

U.S. PATENT DOCUMENTS

| | | | | |
|---|---|---|---|---|
| 3,977,993 | A | 8/1976 | Lynch | 252/317 |
| 5,830,548 | A | 11/1998 | Andersen et al. | 428/36.4 |
| 6,005,012 | A | 12/1999 | Hrubesh et al. | 521/53 |

FOREIGN PATENT DOCUMENTS

| | | | |
|---|---|---|---|
| EP | 537648 | * | 4/1993 |
| EP | 0 846 802 A1 | | 6/1998 |
| WO | WO 01/06054 A1 | | 1/2001 |

* cited by examiner

*Primary Examiner*—Erma Cameron
(74) *Attorney, Agent, or Firm*—Eddie E. Scott; Alan H. Thompson

(57) ABSTRACT

Fibers, and fabrics produced from the fibers, are made water repellent, fire-retardant and/or thermally insulating by filling void spaces in the fibers and/or fabrics with a powdered material. When the powder is sufficiently finely divided, it clings tenaciously to the fabric's fibers and to itself, resisting the tendency to be removed from the fabric.

9 Claims, 1 Drawing Sheet

FIBERS AND FABRICS WITH INSULATING, WATER-PROOFING, AND FLAME-RESISTANT PROPERTIES

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of Endeavor

The present invention relates to fibers and fabrics and more particularly to fibers and fabrics with insulating, waterproofing, and flame-resistant properties.

2. State of Technology

U.S. Pat. No. 6,040,251 for garments of barrier webs by J. Michael Caldwell, patented Mar. 21, 2000, incorporated herein by reference, provides the following background information, "Barrier fabrics are generally characterized by being impervious to penetration by liquids. There is a class of barrier fabrics which, additionally, are vapor permeable to provide what is termed breathability. Barrier fabrics are especially useful in the medical career apparel garments. The barrier fabrics in the prior art can be generally classified as disposable and reuseable. Disposable fabrics are typically constructed from nonwovens made from light weight synthetic fibers or synthetic fibers blended with natural fibers. Performance of disposable nonwoven fabrics in terms of liquid repellency and flame retardancy are quite acceptable. Reusable fabrics are normally woven and may be constructed from cotton or cotton/polyester blends of a high thread count to provide a physical barrier to prevent or reduce the spread of infectious materials and vectors.

While reusable woven fabrics generally offer more comfort in terms of drapeability, breathability, transmission of heat and water vapor, stiffness, etc., and improved (reduced) cost per use, they lack the liquid repellency the market has come to expect on the basis of experience with the disposables, especially after repeated launderings and/or steam (autoclave) sterilizations.

Woven reusable surgical barrier fabrics must meet or exceed the current criteria for National Fire Protection Association (NFPA-99) and the Association of Operating Room Nurses (AORN) "Recommended Practices-Aseptic Barrier Material for Surgical Gowns and Drapes" used in constructing operating room wearing apparel, draping and gowning materials. To be effective, the fabric must be resistant to blood and aqueous fluid (resist liquid penetration); abrasion resistant to withstand continued reprocessing; lint free to reduce the number of particles and to reduce the dissemination of particles into the wound; drapeable; sufficiently porous to eliminate heat buildup; and flame resistant.

Reusable fabrics should withstand multiple laundering and, where necessary, sterilization (autoclaving) cycles; be non-abrasive and free of toxic ingredients and non-fast dyes; be resistant to tears and punctures; provide an effective barrier to microbes, preferably be bacteriostatic in their own right; and the reusable material should maintain its integrity over its expected useful life.

None of the fabrics or the fabrics taught in the prior art has the physical characteristics of (1) being substantially resistant or impermeable to liquids, such as water, (2) being permeable to gases, and (3) impermeable to microorganisms. In addition, none of the fabrics taught in the prior art teach or suggest fabrics that are capable of selectively removing or retaining microorganisms or other particles or molecules from the surrounding milieu.

In the prior art, it has been proposed to treat porous webs, especially fabrics, with silicone resins and also with fluorochemicals. Conventional treatments of webs fall into the general categories of (i) surface coatings and (ii) saturations or impregnations.

For example, U.S. Pat. Nos. 3,436,366; 3,639,155; 4,472,470; 4,500,584; and 4,666,765 disclose silicone coated fabrics. Silicone coatings are known to exhibit relative inertness to extreme temperatures of both heat and cold and to be relatively resistant to ozone and ultraviolet light. Also, a silicone coating can selectively exhibit strength enhancement, flame retardancy and/or resistance to soiling. Fluorochemical treatment of webs is known to impart properties, such as soil resistance, grease resistance, and the like.

Prior art fluorochemical and silicone fabric treatment evidently can protect only that side of the fabric upon which they are disposed. Such treatments significantly alter the hand, or tactile feel, of the treated side. Prior silicone fabric coatings typically degrade the tactile finish, or hand, of the fabric and give the coated fabric side a rubberized finish which is not appealing for many fabric uses, particularly garments.

U.S. Pat. No. 4,454,191 describes a waterproof and moisture-conducting fabric coated with a hydrophilic polymer. The polymer is a compressed foam of an acrylic resin modified with polyvinyl chloride or polyurethane and serves as a sort of "sponge," soaking up excess moisture vapor. Other microporous polymeric coatings have been used in prior art attempts to make a garment breathable, yet waterproof.

Various polyorganosiloxane compositions are taught in the prior art that can be used for making coatings that impart water-repellency to fabrics. Typical of such teachings is the process described in U.S. Pat. No. 4,370,365 which describes a water repellent agent comprising, in addition to an organohydrogenpolysiloxane, either one or a combination of linear organopolysiloxanes containing alkene groups, and a resinous organopolysiloxane containing tetrafunctional and monofunctional siloxane units. The resultant mixture is catalyzed for curing and dispersed into an aqueous emulsion. The fabric is dipped in the emulsion and heated. The resultant product is said to have a good "hand" and to possess waterproofness.

This type of treatment for rendering fabrics water repellent without affecting their "feel" is common and well known in the art. However, it has not been shown that polyorganosiloxanes have been coated on fabrics in such a way that both high levels of resistance to water by the fibers/filaments and high levels of permeability to water vapor are achieved. As used herein, the term "high levels of permeability to water vapor" has reference to a value of at least about 500 gms/m.sup. 2/day, as measured by ASTM E96-80B. Also, as used herein, the term "high level of waterproofness" is defined by selective testing methodologies discussed later in this specification. These methodologies particularly deal with water resistance of fabrics and their component fibers.

Porous webs have been further shown to be surface coated in, for example, U.S. Pat. Nos. 4,478,895; 4,112,179; 4,297,265; 2,893,962; 4,504,549; 3,360,394; 4,293,611; 4,472,470; and 4,666,765. These surface coatings impart various characteristics to the surface of a web, but do not substantially impregnate the web fibers. Such coatings remain on the surface and do not provide a film over the individual internal fibers and/or yarn bundles of the web. In addition, such coatings on the web surface tend to wash away quickly.

Prior art treatments of webs by saturation or impregnation also suffer from limitations. Saturation, such as accomplished by padbath immersion, or the like, is capable of producing variable concentrations of a given saturant chemical.

To treat a flexible web, by heavy saturation or impregnation with a polymer material, such as a silicone resin, the prior art has suggested immersion of the flexible web, or fabric, in a padbath, or the like, using a low viscosity liquid silicone resin so that the low viscosity liquid can flow readily into, and be adsorbed or absorbed therewithin. The silicone resin treated product is typically a rubberized web, or fabric, that is very heavily impregnated with silicone. Such a treated web is substantially devoid of its original tactile and visual properties, and instead has the characteristic rubbery properties of a cured silicone polymer.

International Patent Application W00106054 A1 for nanoparticle-based permanent treatment for textiles by Soane et al, published Jan. 25, 2001 provides the following information, "an agent or other payload entrapped, that is, surrounded by or contained within a synthetic, polymer shell or matrix that is reactive to fibers, yarns, fabrics, or webs, to give textile-reactive beads or matrices. The beads or matrices are micrometric or nanometric in size, and are herein collectively and interchangeably referred to as "nanobeads" and "nanoparticles." The nanobead/nanoparticle of the invention may comprise a polymeric shell surrounding the payload or it may comprise a three-dimensional polymeric network entrapping the payload, both of which are referred to herein as a polymer shell." By "textile-reactive" is meant that the payload bead will form a chemical covalent bond with the fiber, yarn, fabric, textile, finished goods (including apparel), or other web or substrate to be treated. The polymer shell or polymer network of the payload nanoparticle has a surface that includes functional groups for binding or attachment to the fibers, filaments or structural components or elements (referred to collectively herein and in the appended claims as "fibers") of the textiles or other webs to be treated, to provide permanent attachment of the payload to the fibers. Alternatively, the surface of the nanobead includes functional groups that can bind to a linker molecule that will in turn bind or attach the bead to the fiber. In either case, these functional groups are referred to herein as "textile-reactive functional groups" or "fiber-reactive functional groups" or "substrate-reactive functional groups." The terms "payload" and "payload agent" as used herein refer collectively to any material or agent that would be desirable for permanent attachment to or treatment of a textile or other web. Alternatively, the payload agent may be released from the cage of the payload nanobead in a controlled and prolonged fashion. The chemical linkage on the surface of the nanobead does not involve the molecules of the payload. The payload agents are physically entrapped within the nanoparticle, thus requiring no chemical modifications of the agents themselves. The resulting encapsulated payload preparations or nanoparticles have improved retention within and on the textile or web fiber structure without changing the inherent character of the payload agent. The architecture of the shell or matrix of the nanobead can be formulated and fine-tuned to exhibit controlled release of the entrapped payload, ranging from constant but prolonged release (desirable for drugs, biologic or anti-biologic agents, softeners, and fragrances, for example) to zero release (desirable for dyes, metallic reflector colloids, and sunblock agents, for example). In an encapsulated configuration, the beads will desirably insulate the payload from the skin, preventing potential allergic reactions. In addition, the nanoparticle can be designed to respond to different environmental stimuli (such as temperature, light change, pH, or moisture) to increase the rate of release, color change, or temperature change at certain times or in certain selected spots or locations on the textile or finished good. This invention is further directed to the fibers, yarns, fabrics (which may be woven, knitted, stitch-bonded or nonwoven), other textiles, or finished goods (encompassed collectively herein under the terms "textiles" or "webs") treated with the textile-reactive nanoparticles. Such textiles and webs exhibit a greatly improved retention or durability of the payload agent and its activity, even after multiple washings. Methods are provided for synthesizing a textile-reactive payload-containing nanoparticle. The preparations of the invention may be formed via one of several methods of encapsulation, such as interfacial polymerization, microemulsion polymerization, precipitation polymerization, and diffusion. Multi-component mixture preparation followed by atom ization/spraying into a drying chamber is yet another processing scheme. Reactive functional groups on the polymer shell provide a means for attaching the payload nanoparticles to textiles."

U.S. Pat. No. 2,673,823 teaches impregnating a polymer into the interstices of a fabric and thus fully filling the interstices. This patent provides no control of the saturation of the fabric. It teaches full saturation of the interstices of the fabric.

The prior art application of liquid or paste compositions to textiles for purposes of saturation and/or impregnation is typically accomplished by an immersion process. Particularly for flexible webs, including fabric, an immersion application of a liquid or paste composition to the web is achieved, for example, by the so-called padding process wherein a fabric material is passed first through a bath and subsequently through squeeze rollers in the process sometimes called single-dip, single-nip padding. Alternatively, for example, the fabric can be passed between squeeze rollers, the bottom one of which carries the liquid or paste composition in a process sometimes called double-dip or double-nip padding.

Prior art treatment of webs that force a composition into the spaces of the web while maintaining some breathability have relied on using low viscosity compositions or solvents to aid in the flow of the composition. U.S. Pat. No. 3,594,213 describes a process for impregnating or coating fabrics with liquefied compositions to create a breathable fabric. This patent imparts no energy into the composition to liquefy it while forcing it into the spaces of the web. The composition is substantially liquefied before placement onto and into the web. U.S. Pat. No. 4,588,614 teaches a method for incorporating an active agent into a porous substrate.

This patent utilizes a solvent to aid in the incorporation of the active agent into the web. Prior art apparatus for the coating of webs, including fabrics, generally deposits a coating onto the fabric at a desired thickness. Coating at a predetermined thickness can be achieved by deposition of coating material or by the scraping of a coating upon the fabric by knives. Flexible webs are generally urged between oppositely disposed surfaces, one of which would be a doctoring blade or drag knife. The blade or knife smooth the coating and maintain the thickness of the coating to a desired thickness. For example, it is possible to apply a relatively thick silicone liquid elastomer coating to a rough web, typically of fiberglass, in order to make architectural fabric as is taught in U.S. Pat. No. 4,666,765. In this example, the drag knives are set to a thickness of about 2 to 10 mils thicker than the web thickness. This setting, depending on the coating speed, can yield a base coat thickness of approximately 3 to 12 mils thicker than the web thickness.

Various types of coatings, and various coating thicknesses, are possible. However, a general principle of coating machinery is that the coating material is swept, or dragged, along the surface of the fabric. No special attention is normally given to any pressured forcing of the coating into the fabric, therein making the coating also serve as an impregnant. Of course, some coating will be urged into surface regions of the fabric by the coating process. Generally, however, application of high transversely exerted (against a fiber or web surface) forces at the location of the coating deposition and/or smoothing is not desired in the prior art processes because it is the goal of the prior art coating processes to leave a definite thickness of coating material upon a surface of the fabric, and not to scrape the fabric clean of surface-located coating material.

One prior art silicone resin composition is taught by U.S. Pat. Nos. 4,472,470 and 4,500,584, and includes a vinyl terminated polysiloxane, typically one having a viscosity of up to about 2,000,000 centipoises at 25. degree. C., and a resinous organosiloxane polymer. The composition further includes a platinum catalyst, and an organohydrogenpolysiloxane crosslinking agent, and is typically liquid. Such composition is curable at temperatures ranging from room temperature to 100 C or higher depending upon such variables as the amount of platinum catalyst present in the composition, and the time and the temperature allowed for curing.

Such compositions may additionally include fillers, including finely divided inorganic fillers. Silicone resin compositions that are free of any fillers are generally transparent or translucent, whereas silicone resin compositions containing fillers are translucent or opaque depending upon the particular filler employed. Cured silicone resin compositions are variously more resinous, or hard, dependent upon such variables as the ratio of resinous copolymer to vinyl terminated polysiloxane, the viscosity of the polysiloxane, and the like.

Curing (including polymerization and controlled crosslinking) can encompass the same reactions. However, in the fabric finishing arts, such terms can be used to identify different phenomena. Thus, controllable and controlled curing, which is taught by the prior art, may not be the same as control of crosslinking. In the fabric finishing arts, curing is a process by which resins or plastics are set in or on textile materials, usually by heating. Controlled crosslinking may be considered to be a separate chemical reaction from curing in the fabric finishing arts. Controlled crosslinking can occur between substances that are already cured. Controlled crosslinking can stabilize fibers, such as cellulosic fibers through chemical reaction with certain compounds applied thereto. Controlled crosslinking can improve mechanical factors such as wrinkle performance and can significantly improve and control the hand and drape of the web. Polymerization can refer to polymer formation or polymer growth.

What is needed in the industry is a barrier fabric that is impermeable to liquids, is permeable to gases, and is impermeable to microorganisms. In addition, what is needed are methods and processes for producing fabrics with predetermined pore sizes that allow the manufacturer to produce a fabric with a desired pore size."

European Patent No. EP0846802 for a method of filling a hollow fiber with gel by Hajime Izawa and Togi Suzuki of Teijin Limited-Osaka Research Center, published Jun. 10, 1998, incorporated herein by reference, provides the following description, "This invention provides a method for filling a hollow portion of a hollow fiber with a gel without requiring special equipment such as pressure resistant facilities and enabling an industrial mass production, which comprises immersing said hollow fiber on the surface of which pores are diffusely distributed to communicate to said hollow portion in a gelable liquid, leaving said hollow fiber at room temperature so that said gelable liquid may be absorbed through said pores into the hollow portion, and finally causing thus absorbed gelable liquid gelled."

U.S. Pat. No. 5,830,548 for articles of manufacture and methods for manufacturing laminate structures including inorganically filled sheets by Per Just Andersen and Simon K. Hodson, patented Nov. 3, 1998, incorporated herein by reference, provides the following description, "Compositions and methods for manufacturing composite laminate structures incorporating sheets having a moldable matrix are disclosed. Suitable compositions are prepared by mixing together a water dispersable organic binder, water, and appropriate additives (such as aggregates and fibers) which impart predetermined properties so that a sheet formed therefrom has the desired performance criteria. The compositions are formed into sheets by first extruding them into a sheet and then calendaring the sheet using a set of rollers. The calendered sheets are dried in an accelerated manner to form a substantially hardened sheet. The drying process is performed by heated rollers and/or a drying chamber. The inorganically filled sheets so formed may have properties substantially similar to sheets made from presently used materials like paper, cardboard, polystyrene, or plastic. Such sheets can be rolled, pressed, scored, perforated, folded, and glued before or after being incorporated into composite laminate structures. Such composite laminate structures have especial utility in the mass production of containers, particularly food and beverage containers."

U.S. Pat. No. 6,129,978 for Porous webs having a polymer composition controllably placed therein by J. Michael Caldwell, patented Oct. 10, 2000, incorporated herein by reference, provides the following description, "The present invention relates to a porous web comprising a plurality of structural elements with interstitial spaces therebetween, wherein at least some of the structural elements of the top and bottom surfaces of the web are encapsulated by a cured, shear thinned polymer composition and most of the interstitial spaces are open. The invention also relates to a porous web having a substantially continuous region of a cured, shear thinned polymer composition extending through the web so that the polymer composition fills the interstitial spaces and adheres adjacent structural elements of the web in the region. In the areas of the web above and below the filled region, at least some of the structural elements are encapsulated and most of the interstitial spaces are open."

U.S. Pat. No. 6,180,037 for methods for the manufacture of sheets having a highly inorganically filled organic polymer matrix by Just Andersen and Simon K. Hodson, patented Jan. 30, 2001, provides the following description, "Compositions and methods for manufacturing sheets having a highly inorganically filled matrix. Suitable inorganically filled mixtures are prepared by mixing together an organic polymer binder, water, one or more inorganic aggregate materials, fibers, and optional admixtures in the correct proportions in order to form a sheet which has the desired performance criteria. The inorganically filled mixtures are formed into sheets by first extruding the mixtures and the passing the extruded materials between a set of rollers. The rolled sheets are dried in an accelerated manner to form a substantially hardened sheet, such as by heated rollers and/or a drying chamber. The inorganically filled sheets may have properties substantially similar to sheets presently made from traditional materials like paper, cardboard, polystyrene, plastic, or metal. Such sheets can be rolled, pressed, scored, perforated, folded, and glued. They have especial utility in the mass production of containers, particularly food and beverage containers."

SUMMARY OF THE INVENTION

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides fibers and fabrics that have desirable properties. Embodiments of the invention provide fibers and fabrics that have insulating, waterproofing, and/or fire resistant properties. In various embodiment of the invention, fibers, and fabrics produced from the fibers, are made water repellent, fire-retardant and/or thermally insulating by filling the void spaces in the fibers and/or fabrics with a powdered material. When the powder is sufficiently finely divided, it clings tenaciously to the fabric's fibers and to itself, resisting the tendency to be removed from the fabric. The present invention has many uses including uses for military clothing, blankets, tents, raingear, fire/flame protection clothing, blankets, tents, raingear, fire/flame protection, ect.

In one embodiment of the invention a single fiber strand includes a porous fiber strand having voids. At least some of the voids are at least partially filled with particles in the size range of 1–500 nm. In another embodiment a single fiber is made up of multiplicity of smaller single fiber strands. The smaller single porous fiber strands have voids and at least some of the voids are at least partially filled with particles in the size range of 1–500 nm. In another embodiment of the invention a single fiber is made up of multiplicity of smaller single fiber strands. The multiplicity of smaller single porous or non-porous fiber strands have voids between the smaller single porous or non-porous fiber strands. At least a portion of the voids are at least partially filled with particles in the size range of 1–500 nm.

In various embodiments of the invention the particles are at least partially composed of at least one of the following: a porous material, or a nanoporous material, or a nanoporous powdered material, or a solgel derived material, or an aerogel-like material, or an aerogel, or an inorganic material, or aggregates of inorganic particle material, or combinations of the materials. In other embodiments of the invention the particles are at least partially composed of at least one of the following: an insulating material, or a thermally insulating material, or a water repellant material, or a hydrophobic material, or a hydrophobic, nanoporous powdered material, or a hydrophobic silica aerogel, or a fire resistant material, or combinations of the materials. The present invention is not be limited to silica aerogels, other metal oxide aerogels, eg., alumina, zirconia, tantala, titania, etc., and carbon aerogels are included. The present invention also includes laminates of aerogel powder or powder impregnated fabrics, with other fabrics—where the aerogel layer provides the physical properties of repellancy, fire resistence, and thermal resistence (as well as providing other barrier possibilities by absorption.)

Another embodiment of the present invention provides a method of producing a fiber. A porous fiber strand containing voids is provided. The voids are filled with particles in the size range of 1–500 nm. The particles are at least partially composed of at least one of the following: a porous material, or a nanoporous material, or a nanoporous powdered material, or a solgel derived material, or an aerogel-like material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or a fire resistant material, or combinations of the materials. The present invention is not be limited to silica aerogels, other metal oxide aerogels, eg., alumina, zirconia, tantala, titania, etc., and carbon aerogels are included. The method includes the step of: filling the voids with a solution which precipitates particles as it dries, or filling the voids with a solution containing a colloidal suspension of particles which remain when the liquid dries, or filling the voids with a dry powder by passing the fibers through the powder in a manner in which the particles attach to the fibers, or filling the voids with a dry powder by passing the powder over the fibers in a manner in which the particles attach to the fibers, or filling the voids with a dry powder by forcing dry powder to enter the space using rollers, or filling the voids with a dry powder by forcing dry powder to enter the space using a press, or combinations of the steps.

Another embodiment of the present invention provides a method of producing a fiber made up of multiplicity of smaller single fiber strands. Voids are located between the smaller single fiber strands. The voids are filled with particles in the size range of 1–500 nm. In various embodiments the particles are at least partially composed of at least one of the following: a porous material, or a nanoporous material, or a nanoporous powdered material, or a solgel derived material, or an aerogel-like material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or a fire resistant material, or combinations of the materials. The present invention is not be limited to silica aerogels, other metal oxide aerogels, eg., alumina, zirconia, tantala, titania, etc., and carbon aerogels are included. The method includes the step of: filling the voids with a solution which precipitates particles as it dries, or filling the voids with a solution containing a colloidal suspension of particles which remain when the liquid dries, or filling the voids with a dry powder by passing the fibers through the powder in a manner in which the particles attach to the fibers, or filling the voids with a dry powder by passing the powder over the fibers in a manner in which the particles attach to the fibers, or filling the voids with a dry powder by forcing dry powder to enter the space using rollers, or filling the voids with a dry powder by forcing dry powder to enter the space using a press, or combinations of the steps.

Another embodiment of the invention provides a method of producing a fabric. A multiplicity of fibers are located in association with each other to form the fabric. The fibers containing a void volume located either in the fibers or between the fibers or both in the fibers and between the fibers. At least a portion of the void volume is filled with particles in the size range of 1–500 nm. In various embodiments the particles are at least partially composed of at least one of the following: a porous material, or a nanoporous material, or a nanoporous powdered material, or a solgel derived material, or an aerogel-like material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or a fire resistant material, or combinations of the materials. The present invention is not be limited to silica aerogels, other metal oxide aerogels, eg., alumina, zirconia, tantala, titania, etc., and carbon aerogels are included. The method includes the step of: filling the voids with a solution which precipitates particles as it dries, or filling the voids with a solution containing a colloidal suspension of particles which remain when the liquid dries, or filling the voids with a dry powder by passing the fibers through the powder in a manner in which the particles attach to the fibers, or filling the voids with a dry powder by passing the powder over the fibers in a manner in which the particles attach to the fibers, or filling the voids with a dry powder by forcing dry powder to enter the space using rollers, or filling the voids with a dry powder by forcing dry powder to enter the space using a press, or combinations of the steps.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1:
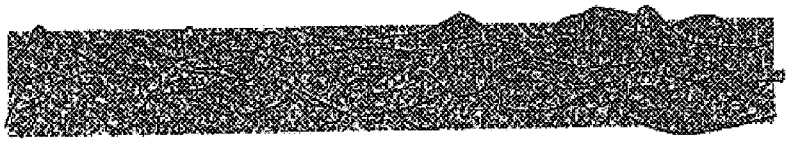
FIG. 1 is a side view showing a schematic drawing of a portion of a single fiber made up of strands of smaller fibers.

Referring now to the drawings, to the following detailed information, and to incorporated materials; a detailed description of the invention, including specific embodiments, are described. The description of the specific embodiments, together with the general description of the invention, serve to explain the principles of the invention.

The present invention provides fibers and fabrics that have desirable properties. Embodiments of the invention provide fibers and fabrics that have insulating, waterproofing, and fire resistant properties. In various embodiment of the invention, fibers, and fabrics produced from the fibers, are made water repellent, fire-retardant and/or thermally insulating by filling the void spaces in the fibers and/or fabrics with a powdered material. When the powder is sufficiently finely divided, it clings tenaciously to the fabric's fibers and to itself, resisting the tendency to be removed from the fabric. Thus, this treatment offers substantial long term improvement of the water repellant and thermal insulation properties over the untreated fabric, while not adding much additional weight.

Embodiments of the Invention Using a Fiber Made of Smaller Single Fibers

In one embodiment of the present invention a method is described of producing a fiber made up of multiplicity of smaller single fiber strands. This embodiment includes the steps of providing an assembly of single fiber strands. The assembly has a void volume between the smaller single fiber strands. The void volume is filled with particles in the size range of 1–500 nm. Various embodiments of method of filling the void volume will be described. The embodiments include filling the void volume with a solution that precipitates particles as it dries. In another embodiment the void volume is filled with a solution containing a colloidal suspension of particles that remain when the liquid dries. In another embodiment the void volume is filled with a dry powder by passing the fibers through a powder in a manner in which the particles attach to the fibers. In another embodiment the void volume is filled with a dry powder by passing the powder over the fibers in a manner in which the powder particles attach to the fibers. In another embodiment the void volume is filled a dry powder by forcing the dry powder to enter the space using rollers. In another embodiment the void volume is filled by forcing dry powder to enter the space using a press.

In one of the embodiments of producing a fiber made up of multiplicity of smaller single fiber strands, the particles are at least partially composed of a porous material. In one of the embodiments of producing a fiber made up of multiplicity of smaller single fiber strands, the particles are at least partially composed of a nanoporous material. In one of the embodiments of producing a fiber made up of multiplicity of smaller single fiber strands, the particles are at least partially composed of a nanoporous powdered material. In various other embodiments of the invention the particles are at least partially, composed of a solgel derived material, composed of an aerogel-like material, composed of an aerogel, composed of an inorganic material, composed of aggregates of inorganic particles, contain an insulating material, contain a thermally insulating material, composed of an insulating material, composed of a thermally insulating material, contain a water repellant material, contain a hydrophobic material, contain a hydrophobic, nanoporous powdered material, composed of a water repellant material, composed of a hydrophobic material, composed of a hydrophobic, nanoporous powdered material, composed of a hydrophobic silica aerogel, contain a fire resistant material, and/or composed of a fire resistant material. The present invention is not be limited to silica aerogels, other metal oxide aerogels, eg., alumina, zirconia, tantala, titania, etc., and carbon aerogels are included. The present invention also includes laminates of aerogel powder or powder impregnated fabrics, with other fabrics—where the aerogel layer provides the physical properties of repellancy, fire resistence, and thermal resistence (as well as providing other barrier possibilities by absorption.)

Embodiments of the Invention Using a Porous Fiber

The smaller fiber strands described above may be porous or nonporous. Embodiments of the invention utilizing porous fibers include the steps of providing a porous fiber strand wherein the porous fiber strand contains voids. The voids are filled with particles in the size range of 1–100 nm. Various embodiments of method of filling the voids will be described. In one embodiment the voids are filled with a solution which precipitates particles as it dries. In another embodiment the voids are filled with a solution containing a colloidal suspension of particles which remain when the liquid dries. Other embodiments include: filling the voids with a dry powder by passing the fibers through the powder in a manner in which the particles attach to the fibers, filling the voids with a dry powder by passing the powder over the fibers in a manner in which the particles attach to the fibers, filling the voids with a dry powder by forcing dry powder to enter the space using rollers, and/or filling the voids with a dry powder by forcing dry powder to enter the space using a press. In various embodiments the particles are at least partially composed of: a porous material, or a nanoporous material, or a nanoporous powdered material, or a solgel derived material, or an aerogel-like material, or an aerogel, or an inorganic material, or an insulating material, or a thermally insulating material, or aggregates of inorganic particles, or combinations of the foregoing materials.

In various embodiments the particles at least partially contain: a water repellant material, or a hydrophobic material, or a hydrophobic, nanoporous powdered material, or a water repellant material, or a hydrophobic material, or a hydrophobic, nanoporous powdered material, or a hydrophobic silica aerogel, or a fire resistant material, or a fire resistant material, or combinations of the foregoing materials. The present invention is not be limited to silica aerogels, other metal oxide aerogels, eg., alumina, zirconia, tantala, titania, etc., and carbon aerogels are included. Laminates of aerogel powder or powder impregnated fabrics, with other fabrics—where the aerogel layer provides the physical properties of repellancy, fire resistence, and thermal resistence (as well as providing other barrier possibilities by absorption) are included.

Fabric Manufacturing Embodiments of the Invention

The fibers described above are used in various embodiments to produce fabrics. 131. In one embodiment of the invention a fabric is produced by the steps of: providing a multiplicity of fibers, positioning the multiplicity of fibers in association with each other to form the fabric, the fibers containing a void volume located either in the fibers or between the fibers or both in the fibers and between the fibers, and filling at least a portion of the void volume with particles in the size range of 1–500 nm.

Various embodiments of method of filling the void volume will be described. The embodiments include filling the void volume with a solution that precipitates particles as it dries. In another embodiment the void volume is filled with a solution containing a colloidal suspension of particles that remain when the liquid dries. In another embodiment the void volume is filled with a dry powder by passing the fibers through a powder in a manner in which the particles attach to the fibers. In another embodiment the void volume is filled with a dry powder by passing the powder over the fibers in a manner in which the powder particles attach to the fibers. In another embodiment the void volume is filled a dry powder by forcing the dry powder to enter the space using rollers. In another embodiment the void volume is filled by forcing dry powder to enter the space using a press.

In one of the embodiments of producing a fabric, the particles are at least partially composed of a porous material. In one of the embodiments of producing a fabric, the particles are at least partially composed of a nanoporous material. In one of the embodiments of producing a fabric, the particles are at least partially composed of a nanoporous powdered material. In various other embodiments of the invention the particles are at least partially, composed of a solgel derived material, composed of an aerogel-like material, composed of an aerogel, composed of an inorganic material, composed of aggregates of inorganic particles, contain an insulating material, contain a thermally insulating material, composed of an insulating material, composed of a thermally insulating material, contain a water repellant material, contain a hydrophobic material, contain a hydrophobic, nanoporous powdered material, composed of a water repellant material, composed of a hydrophobic material, composed of a hydrophobic, nanoporous powdered material, composed of a hydrophobic silica aerogel, contain a fire resistant material, and/or composed of a fire resistant material. The present invention is not be limited to silica aerogels, other metal oxide aerogels, eg., alumina, zirconia, tantala, titania, etc., and carbon aerogels, and laminates of aerogel powder or powder impregnated fabrics, with other fabrics—where the aerogel layer provides the physical properties of repellancy, fire resistence, and thermal resistence (as well as providing other barrier possibilities by absorption.)

Incorporation of Existing Technologies

The embodiments described above include the use of know manufacturing systems for processing fibers and processing fabrics. The nanoporous powder can be any porous material that exhibits a microstructure consisting of submicrometer pores and particles. In some embodiments of the invention the powders should have a composition such that the bulk material is not easily wet by pure water; preferably, the bulk material would make a contact angle greater than 90° with a water droplet on its surface. The powder can be applied to the fibers or to the woven fabric at any time; preferably, by pressing the dry powder into the fibers or fabric in a manner that results in effectively filling the available void spaces. In some embodiments of the invention sol-gel derived and aerogel-like materials are used.

The composite fabric consisting of the fibers and nanoporous powder gives the fabric the properties of lightweight, water-proof, thermal insulating, and fire retarding (if inorganic powders are used). For example, a linen fabric treated with 19% by weight of hydrophobic silica aerogel, completely shed water and its thermal resistance improved by 31% over the same thickness of un-treated fabric. The same treated fabric withstands a flame temperature of 525° F. before scorching, 7 times longer than the untreated fabric.

Aside from metal oxide aerogels, organic aerogels result from the reactions of certain organic compounds, for example (1) resorcinol with formaldehyde (known as RF aerogel), (2) melamine with formaldehyde (known as MF aerogel) and (3) phenolic-furfural with propanol. Such aerogels can be prepared in monolithic form and have been employed in double layer capacitors. The present invention is not be limited to silica aerogels, other metal oxide aerogels, eg., alumina, zirconia, tantala, titania, etc., and carbon aerogels are included.

Many applications of aerogels require exposure to water or atmospheric moisture. Normally aerogel materials have a large affinity to absorb liquids such as water due to their high porosity with pores open to the surface. However, present aerogels are prepared either hydrophilic (i.e., absorb liquid water) or are only temporarily hydrophobic (i.e., shed liquid water). Methods w are needed to either initially prepare hydrophobic aerogels, or treat the dried and/or fully prepared aerogels to achieve permanent hydrophobicity at ambient conditions as well as over a range of temperature and pressure conditions.

As early as the 1970's, fluidized beds of highly dispersed oxide and mixed oxide particles have been treated with various organic silicon compounds and controlled amounts of steam to produce products having hydrophobic properties. See, for instance, U.S. Pat. No. 3,873,337, where Laufer et. al. describe the fluidized bed treatment of highly dispersed, relatively low surface area (130 m2/g), low porosity oxides with gaseous dialkyldichlorosilane and water in an atmosphere of CO2. However, such treatments do not consider the problems encountered to hydrophobize the present day relatively thick, highly porous, high surface area, monolithic aerogels that are essentially free of dispersed particles.

Even the modification of hydrophilic surfaces of such monolithic, low-density aerogels with methanol vapor by Lee et al., "Low-density, hydrophobic aerogels," Journal of Non-Crystalline Solids, vol. 186 (1995), has produced hydrophobic aerogels for a relatively short period. The very high porosity of such dried aerogels, especially pores on open surfaces having an unusually high affinity to water, contributes to the problem of preparing permanently hydrophobic aerogels. Since many of the present-day applications of the subject aerogels require a wide variety of atmospheric exposures, the search continues to produce a monolithic, transparent and thick aerogel having permanent hydrophobicity at ambient conditions, yet still retain such properties over a wide range of temperature and pressure conditions.

U.S. Pat. No. 6,005,012 for a method for producing hydrophobic aerogels by Hrubesh et al, patented Dec. 21, 1999 provides the following information, "Monolithic aerogels are a special class of open-cell porous materials derived from the supercritical drying of cross-linked inorganic or organic gels. By today's standards, typical aerogels are porous materials in which all structural entities (i.e., pores, particles) are smaller than 5000.ANG. Such materials have ultrafine pore sizes of less than 5000.ANG., continuous porosity, high surface areas of typically 400–1000 m2/g, and a microstructure composed of interconnected colloidal-like particles or polymer chains with typical characteristic diameters of less than 500.ANG. This microstructure is responsible for the exceptional optical, acoustic, thermal, and mechanical properties of such aerogels.

In most instances, it is essential to obtain such dried gels in a monolithic state, i.e., free of cracks. Silica aerogels are the most extensively described aerogel materials in the scientific and patent literature. Aerogels of transition metal oxides, in particular, are not as well described, and these aerogels are expected to possess some properties that are not possible with silica aerogels due to the presence of the transition metal. The new characteristics of the aerogels will produce interesting new materials for optical, magnetic, and catalytic applications.

The first aerogels were translucent pieces of porous silica glass made by S. S. Kistler (U.S. Pat. No. 2,249,767). Kistler's aerogels are prepared by forming silica hydrogels, which are exchanged with alcohol and dried. The alcohol is supercritically extracted in the drying process, and the resulting aerogel has a density of about 0.05 g/cm3. Kistler's process is time-consuming and laborious, and subsequent advances in the art have reduced the processing time and increased the quality and porosity of aerogels.

Other related art discusses the production of metal oxide aerogels other than silica aerogels. Teichner et al., in Advances in Colloid and Interface Science 5:245–273 (1976), provides a general discussion of metal oxide aerogels, including oxides of silicon, aluminum, titanium, zirconium, magnesium, nickel, copper, and molybdenum. Lynch (U.S. Pat. No. 3,977,993) discusses a modified Kistler method for making metal oxide aerogels. These aerogels are made by preparing a hydrogel, exchanging the water in the gel with an organic solvent, and then supercritically extracting the organic solvent. The Lynch patent does not discuss the peculiar problems in using different metals and the process conditions necessary to ensure that the resulting aerogels form large, transparent, intact (monolithic) solids.

European Patent No. 0382310 by Enichem discusses a process for preparing monoliths of metal oxide aerogels. The process comprises an acidic hydrolysis of a metal alkoxide, the gelation of the resulting colloidal solution, and the supercritical drying of the gel. The patent recognizes the difficulty in obtaining monolithic aerogels with metals other than silicon. The patent addresses the problem by adding a powder of a metal oxide to the colloidal solution at the end of hydrolysis, before gelation.

Embodiments Using a Single Fiber made up of Strands of Smaller Fibers

Figure 2:
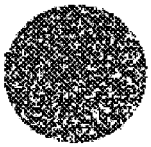
FIG. 2 is an end view of the single fiber show in FIG. 1.

FIG. 1 shows a side view of a portion of a single fiber made up of strands of smaller fibers. Nanosize particles at least partially fill the inside spaces between the strands of the smaller fibers and also are attached to the outside of the smaller fibers and the single fiber. FIG. 2 is an end view of the fiber show in FIG. 1. The present invention provides fibers and fabrics that have insulating, waterproofing, and fire resistant properties. Fibers and fabrics produced from the fibers are made water repellent, fire-retardant and/or thermally insulating by filling the void spaces in the fibers and/or fabrics with a powdered material. When the powder is sufficiently finely divided, it clings tenaciously to the fabric's fibers and to itself, resisting the tendency to be removed from the fabric. Thus, this treatment offers substantial long term improvement of the water repellant and thermal insulation properties over the untreated fabric, while not adding much additional weight to it.

In the present invention, the available void spaces in the fibers and between strands of smaller fibers are filled with a nanoporous material (powdered) whose particles and pores are so small that the thermal resistance of the powder is higher than that of the air that the powder is displacing.

As show in FIGS. 1 and 2, a single fiber is made up of multiplicity of smaller single fiber strands. The smaller single fiber strands can be either smaller single porous or smaller single non-porous fiber strands. The poropus smaller single fiber strands can have individual voids. At least some of the voids are at least partially filled with particles in the size range of 1–100 nm. Also there is a void volume between the smaller single porous or non-porous fiber strands. At least a portion of the void volume is at least partially filled with particles in the size range of 1–100 nm.

In one embodiment of the invention the particles are at least partially composed of a porous material. In other embodiments of the invention the particles are at least partially composed of a nanoporous material, or are at least partially composed of a nanoporous powdered material, or at least partially composed of a solgel derived material, or at least partially composed of an aerogel-like material, or at least partially composed of an aerogel, or at least partially contain an insulating material, or at least partially contain a thermally insulating material, or at least partially composed of an insulating material, or at least partially composed of a thermally insulating material, or at least partially contain a water repellant material, or at least partially contain a hydrophobic material, or at least partially contain a hydrophobic, nanoporous powdered material, or at least partially composed of a water repellant material, or at least partially composed of a hydrophobic material, or at least partially composed of a hydrophobic, nanoporous powdered material, or at least partially composed of a hydrophobic silica aerogel, or at least partially contain a fire resistant material, or at least partially composed of a fire resistant material, or at least partially composed of mixtures of the foregoing materials. The multiplicity of smaller single porous fiber strands associated with each other to form a single fiber.

Figure 3:
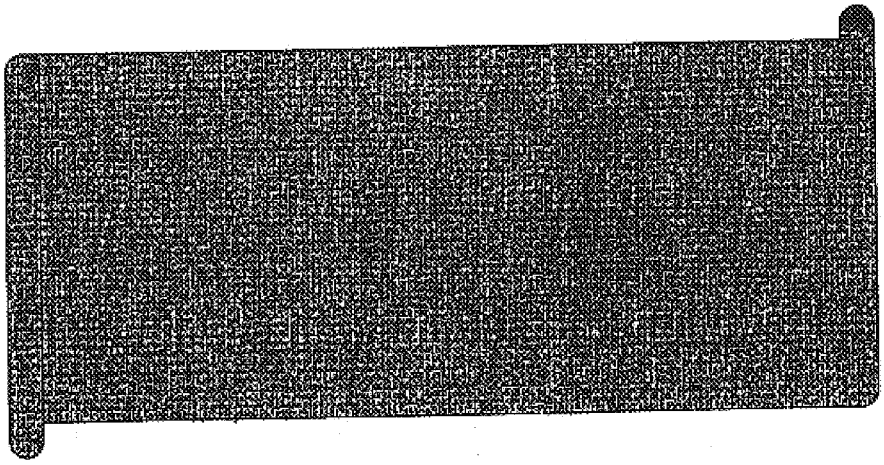
FIG. 3 is a schematic drawing of a fabric made of woven fibers with the space between the woven fibers filled with nanosize particles (diameters in the size range from 1–500 nm.)

FIG. 3 shows a schematic drawing of a fabric made of woven fibers with the space between the woven fibers filled with nanosize particles (diameters in the size range from 1–500 nm.) The fabric is made of a multiplicity of fibers and the multiplicity of fibers are associated with each other to form the fabric. The fabric contains void volumes located either in the fibers or between the fibers or both in the fibers and between the fibers. At least a portion of the void volume at least partially filled with particles in the size range of 1–500 nm. In various embodiments of the invention the particles are at least partially composed of: a porous material, or a nanoporous material, or a nanoporous powdered material, or a solgel derived material, or an aerogel-like material, or an aerogel, or an insulating material, or a thermally insulating material, or an insulating material, or a water repellant material, or a hydrophobic material, or a hydrophobic, nanoporous powdered material, or a water repellant material, or a hydrophobic silica aerogel, or a fire resistant material, or a fire resistant material, or a combination of the foregoing materials. In another embodiment of the present invention, the available void spaces in fibers and fabrics are filled with a nanoporous material (powdered) whose particles and pores are so small that the thermal resistance of the powder is higher than that of the air that the powder is displacing. The powdered nanoporous material is a hydrophobic material that is not easily wet with water. Thus the composite of fabric and powder has improved insulation and water-proofing properties.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of producing a fiber, comprising the steps of:

providing a porous fiber strand, said porous fiber strand containing voids, and filling the voids with particles in the size range of 1–500 nm.

2. The method of claim 1, wherein said particles are at least partially composed of at least one of the following:

a porous material, or a nanoporous material, or a nanoporous powdered material, or a solgel derived material, or an aerogel derived material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or laminates of aerogel powder, or metal oxide aerogels including alumina, zirconia, tantala, and titania, or a fire resistant material, or combinations of said materials.

3. The method of claim 1, including the step of:

filling the voids with a solution which precipitates particles as it dries, or filling the voids with a solution containing a colloidal suspension of particles which remain when the liquid dries, or filling the voids with a dry powder by passing the fibers through the powder in a manner in which the particles attach to said fibers, or filling the voids with a dry powder by passing the powder over said fibers in a manner in which the particles attach to said fibers, or filling the voids with a dry powder by forcing dry powder to enter the space using rollers, or filling the voids with a dry powder by forcing dry powder to enter the space using a press, or combinations of said steps.

4. A method of producing a fiber made up of multiplicity of smaller single fiber strands, comprising the steps of:

providing an assembly of said single fiber strands, said assembly having a void volume between said smaller single fiber strands, and filling said void volume with particles in the size range of 1–500 nm.

5. The method of claim 4, wherein said particles are at least partially composed of at least one of the following:

a porous material, or a nanoporous material, or a nanoporous powdered material, or a solgel derived material, or an aerogel derived material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or metal oxide aerogels including alumina, zirconia, tantala, and titania, or laminates of aerogel powder, or a fire resistant material, or combinations of said materials.

6. The method of claim 5, including the step of:

filling said void volume with a solution which precipitates particles as it dries, or filling said void volume with a solution containing a colloidal suspension of particles which remain when said liquid dries, or filling said void volume with a dry powder by passing said fibers through said powder in a manner in which said particles attach to said fibers, or filling said void volume with a dry powder by passing said powder over said fibers in a manner in which said particles attach to said fibers, or filling said void volume with a dry powder by forcing dry powder to enter said space using rollers, or filling said void volume with a dry powder by forcing dry powder to enter said void volume using a press, or combination of said steps.

7. A method of producing a fabric, comprising the steps of:

providing a multiplicity of fibers, positioning said multiplicity of fibers in association with each other to form said fabric, said fibers containing a void volume located either in said fibers or between said fibers or both in said fibers and between said fibers, and filling at least a portion of said void volume with particles in the size range of 1–100 nm.

8. The method of claim 7, wherein said particles are at least partially composed of at least one of the following:

a porous material, or a nanoporous material, or a nanoporous powdered material, or a solgel derived material, or an aerogel derived material, or an aerogel, or an inorganic material, or aggregates of inorganic particle material, or an insulating material, or a thermally insulating material, or a water repellant material, or a hydrophobic material, or a hydrophobic, nanoporous powdered material, or a hydrophobic silica aerogel, or metal oxide aerogels including alumina, zirconia, tantala, and titania, or a fire resistant material, or combinations of said materials.

9. The method of claim 7, including the step of:

filling said void volume with a solution which precipitates particles as it dries, or filling said void volume with a solution containing a colloidal suspension of particles which remain when said liquid dries, or filling said void volume with a dry powder by passing said fibers through said powder in a manner in which said particles attach to said fibers, or filling said void volume with a dry powder by passing said powder over said fibers in a manner in which said particles attach to said fibers, or filling said void volume with a dry powder by forcing dry powder to enter said space using rollers, or filling said void volume with a dry powder by forcing dry powder to enter said void volume using a press, or combination of said steps.

* * * * *